US006037089A

United States Patent [19]

Yahagi et al.

[11] Patent Number: 6,037,089

[45] Date of Patent: Mar. 14, 2000

[54] ELECTROPHOTOGRAPHIC PHOTOCONDUCTOR AND METHOD FOR PRODUCING SAME

[75] Inventors: Hidetaka Yahagi; Yukihisa Tamura, both of Kawasaki; Masaaki Sakaguchi; Yutaka Nakagishi, both of Osaka, all of Japan

[73] Assignee: Fuji Electric Co., Ltd., Kanagawa, Japan

[21] Appl. No.: 09/111,793

[22] Filed: Jul. 8, 1998

[30] Foreign Application Priority Data

Jul. 15, 1997 [JP] Japan ..... 9-189448

[51] Int. Cl.[7] ..... G03G 5/14

[52] U.S. Cl. ..... 430/65; 430/131

[58] Field of Search ..... 430/65, 131

[56] References Cited

U.S. PATENT DOCUMENTS

| | | | |
|---|---|---|---|
| 3,615,405 | 10/1971 | Shebanow | 430/65 |
| 5,132,196 | 7/1992 | Hirayama et al. | 430/65 |
| 5,908,724 | 6/1999 | Matsui | 430/131 |

FOREIGN PATENT DOCUMENTS

| | | | |
|---|---|---|---|
| 63-116165 | 5/1988 | Japan | 430/65 |
| 2-242264 | 9/1990 | Japan | 430/65 |

OTHER PUBLICATIONS

Japanese Industrial Standard (JIS H8683), "Test Methods for Sealing Quality of Anodic Oxide Coating on Aluminium and Aluminium Alloys", 1994.

*Primary Examiner*—Roland Martin

*Attorney, Agent, or Firm*—Venable; Robert J. Frank; Ashley J. Wells

[57] ABSTRACT

An electrophotographic photoconductor and method for producing same, the electrophotographic photoconductor including an electroconductive substrate; and a photosensitive film laminated on said electroconductive substrate, wherein the electroconductive substrate comprises an aluminum substrate which has an anodic oxidation film on at least one surface thereof and which has been treated with a sealing agent mixture including an additive selected from the group consisting of a phosphate ester surfactant, a naphthalene sulfonate formaldehyde condensate, and a bisphenol A sulfonate formaldehyde condensate and a sealing agent.

7 Claims, 1 Drawing Sheet

ELECTROPHOTOGRAPHIC PHOTOCONDUCTOR AND METHOD FOR PRODUCING SAME

This application is based on Patent Application No. 189,448/1997 filed on Jul. 15, 1997 in Japan, the content of which is incorporated hereinto by reference.

BACKGROUND OF THE INVENTION

1. Field of the Invention

The present invention relates to an aluminum substrate for an electrophotographic photoconductor, where a surface thereof is covered with an anodized aluminum film. Also, the present invention relates to an electrophotographic photoconductor using the aluminum substrate.

2. Description of the Related Art

Heretofore, technical advances in electrophotography have been made in the filed of copier machines and recently have been applied in the field of laser printers and so on. The laser printers provide excellent image qualities and allow high speed and quiet printing operations in comparison with those of the conventional impact printers. Thus, most of the present recording devices, such as printers and copiers, adopt the electrophotographic technologies. Each of electrophotographic photoconductors (hereinafter, also simply referred as a photoconductor) to be provided in those recording devices is prepared by forming a photoconductive layer on a conductive substrate. In most photoconductors, each of them has a photoconductive layer consisting of organic materials and thus the photoconductor is designated as an organic photoconductor. Furthermore, it is now common practice to make each of the photoconductors as a structure having functionally separated layers (i.e., the photoconductive layer is divided into two different layers), where an under-coating layer, a charge-generation layer, and a charge-transport layer are stacked on a substrate in that order. The under-coating layer can be prepared by one of two different processes. In the first process, a resin-based material typically of polyamide or melamine is applied on the surface of the substrate. In the second process, on the other hand, an anodized film (hereinafter, simply referred as a film) is formed on the surface of an aluminum substrate by means of anodic oxidation. Generally, the second process is advantageous in terms of reliability under a high-temperature and high-humidity environment.

Typically, an organic photoconductor, where an organic material is used as its photoconductive layer's material, is formed by a wet-coating method that includes the step of immersing a substrate in a coating-liquid bath containing the organic material being dissolved or dispersed in a solvent. The required level of quality for the photoconductor is that the coated film should be made uniform (i.e., no roughness or irregularities) with no defect of any kind. Thus, the uniformity of the coated film largely depends on a surface condition (i.e., uniformity) of the substrate, remarkably in the case of using wet-coating.

When a substrate having a film formed on its surface is used, quality of the photoconductor itself is almost determined by a surface condition of the substrate after a sealing treatment following an anodic oxidation treatment. The surface condition here means uniform wettability of the surface, so that the coated film should have uniform wettability over the entire surface thereof. It has been clarified that a thickness of the photosensitive layer (particularly, a thickness of the charge-generation layer) becomes uneven when the wettability is not uniform, resulting in defects such as "uneven density" in print quality evaluation.

If contaminants such as oxides and ions are remained on the surface of the substrate before the step of coating the photosensitive layer, they tend to cause image defects such as "black spot" and "fog". Thus, the contaminants are generally removed by washing the substrate with alkali or acid. However, the washing process does not remove the contaminants to a sufficient degree when the sealing state of the film is insufficient, so that it often results in "black spot" or "fog". For determining whether the sealing state is sufficient, a criterion is an admittance value ($Y_{20}$). According to the present invention, it is found that the value ($Y_{20}$) is desirably less than 70 $\mu$S. To decrease the admittance value ($Y_{20}$), sealing treatment at a higher temperature for a longer time is required. Therefore, a value of less than 70 $\mu$S can be obtained by the treatment at least at 80° C. for 10 minutes.

In this description, the admittance value ($Y_{20}$) is provided as a converted value of 20 $\mu$m film thickness according to "Test methods for sealing quality of anodic oxide coatings on aluminum and aluminum alloys", JIS(Japanese Industrial Standard) H8683 (1994) by Japanese Industrial Standards Committee.

As a result of various investigations on any factors involved in the surface state of the film after sealing treatment next to anodic oxidation, changes in surface fine structure substantially affect the wettability. In general, surface configuration immediately after anodic oxidation treatment has a hexagonal columnar fine cell structure with fine pits of about 100 Å in diameter present at the central part. A treatment for sealing these pits is referred to a sealing treatment, in which the film is hydrated in boiling water or steam in order to swell the film to seal the pits, or in general using a nickel acetate solution, the pits are sealed by a combination of hydration reaction of the film and filling with nickel hydroxide produced by hydrolysis of nickel acetate.

However, it has been found that in any of the above treatments, growth of the film by the hydration reaction abnormally occurs reticulately both in the horizontal direction and the vertical direction (film thickness direction), resulting in an irregular surface, which particularly affects the wettability of the photosensitive layer in a dip coating method, and the influence is particularly considerable when the film is treated at high temperatures. Furthermore, sealing treatment of the reticulated surface is not uniform over the entire surface and thus tends to generate irregularities.

Then, an object of the present invention is to provide a substrate for an electrophotographic photoconductor which realizes an admittance value ($Y_{20}$) of 70 $\mu$S or less, has suppressed growth of the film in a vertical direction, and has a uniform and smooth surface of high wettability with a high sealing degree, and an electrophotographic photoconductor using the substrate.

The inventors have conducted intensive studies for solving the above prior art problems and found that by adding a specific surfactant and the like to the prior art sealing agent, growth of film in vertical direction is suppressed and a uniform and smooth surface of good wettability with a high sealing degree can be obtained, thus accomplishing the present invention.

SUMMARY OF THE INVENTION

In a first aspect of the present invention, there is provided a method for producing substrate for an electrophotographic photoconductor comprising the steps of:

forming an anodic oxidation film on the surface of an aluminum substrate;

adding an additive selected from the group consisting of a phosphate type surfactant, a naphthalene sulfonate type formaldehyde condensate, and a bisphenol A sulfonate type formaldehyde condensate to a sealing agent to prepare a sealing agent mixture; and providing sealing treatment to the substrate with the sealing agent mixture.

Here, the sealing agent may be nickel acetate.

The sealing agent may be pure water.

In a second aspect of the present invention, there is provided a substrate for an electrophotographic photoconductor comprising:

an aluminum substrate; and an anodic oxidation film formed on the substrate;

wherein the aluminum substrate is sealing treated with a sealing agent mixture prepared by adding an additive selected from the group consisting of a phosphate type surfactant, a naphthalene sulfonate type formaldehyde condensate, and a bisphenol A sulfonate type formaldehyde condensate to a sealing agent.

Here, the sealing agent may be nickel acetate.

The sealing agent may be pure water.

An admittance value may be 70 $\mu$S or less.

In a third aspect of the present invention, there is provided an electrophotographic photoconductor having at least an electroconductive substrate and a photosensitive film laminated on the electroconductive substrate, wherein the electroconductive substrate is made from an aluminum substrate, the substrate has an anodic oxidation film and is further sealing treated with a sealing agent mixture prepared by adding an additive selected from the group consisting of a phosphate ester type surfactant, a naphthalene sulfonate type formaldehyde condensate, and a bisphenol A sulfonate type formaldehyde condensate to a sealing agent.

Here, The sealing agent may be nickel acetate.

The sealing agent may be pure water.

The electroconductive substrate may have an admittance value of 70 $\mu$S or less.

The above and other objects effects, features and advantages of the present invention will become more apparent from the following description of embodiments thereof taken in conjunction with the accompanying drawings.

DETAILED DESCRIPTION OF PREFERRED EMBODIMENTS

Figure 1:
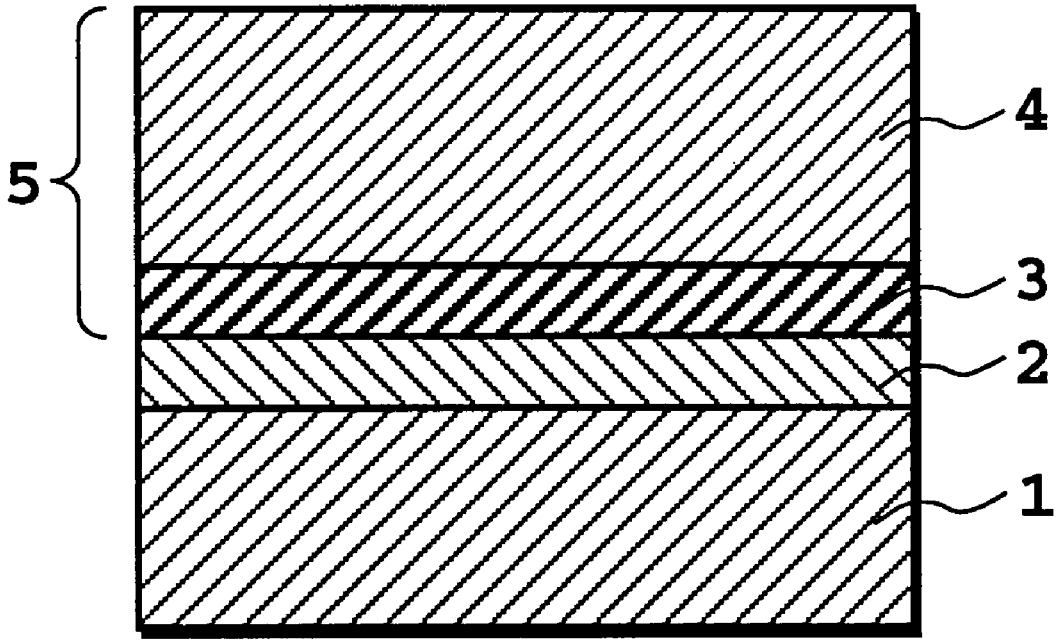
FIG. 1 is a schematic sectional illustration of an embodiment of a negative charge function separation laminated type electrophotographic photoconductor according to the present invention.

In the following, a substrate for an electrophotographic photoconductor and an electrophotographic photoconductor using the same according to the present invention will be described in detail.

The substrate for an electrophotographic photoconductor according to the present invention can be obtained by performing sealing treatment after anodic oxidation film formation of aluminum using a sealing agent mixed with an appropriate amount of one selected from the group of a phosphate type surfactant, a naphthalene sulfonate type formaldehyde condensate, and a bisphenol A sulfonate type formaldehyde condensate.

Next, detailed construction of the electrophotographic photoconductor according to the present invention using the above-described substrate for an electrophotographic photoconductor will be described.

Photoconductors generally include a negative charge function separation laminated type photoconductor, a positive charge function separation laminated type photoconductor, and a positive charge single layer type photoconductor. Here, the negative charge function separation laminated type photoconductor which is a preferable configuration of the present invention will be described in detail as an example.

In the negative charge function separation laminated type photoconductor shown in FIG. 1, a photosensitive layer 5 is laminated further on top of an undercoating layer 2 laminated on an electroconductive substrate 1. In the photosensitive layer 5, a charge transport layer 4 is laminated on a charge generation layer 3 so as to form a function ally separated layers.

The electroconductive substrate 1 has a role as an electrode of the photoconductor and another role as a substrate of other respective layers. The substrate 1 is an aluminum substrate which may be any of cylindrical, plate, and film forms. The aluminum substrate has the aluminum anodic oxidation film on the surface.

The charge generation layer 3 is formed by vacuum deposition of an organic photoconductive substance or by coating a material containing particles of organic photoconductive substance dispersed in a resin binder, which receives light to generate electrostatic charges. The charge generation layer 3 is important to be high in charge generation efficiency and, at the same time, have an infection property of the generated charges to the charge transport layer 4, and preferable to be small in electrical field dependence and good in injection at even low electrical field. As charge generation substances used in the charge generation layer, various phthalocyanine compounds, azo compounds, polycyclic quinone compounds, and derivatives thereof shown as the following chemical formulas (Examples I-1 to 4) can be used.

I-1

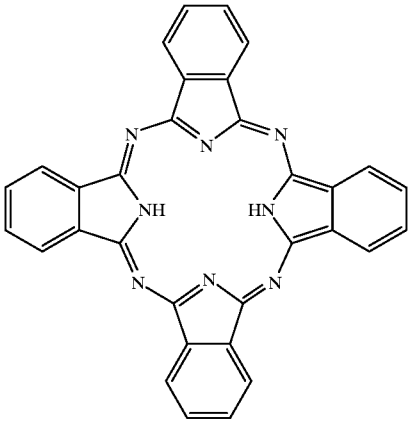

I-2

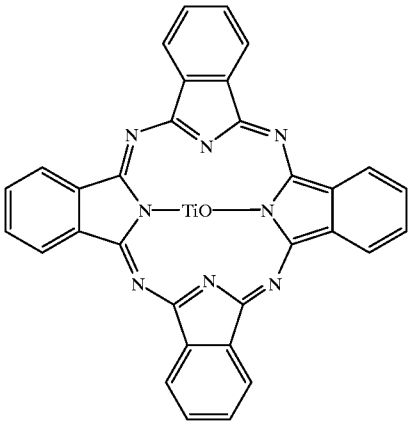

I-3

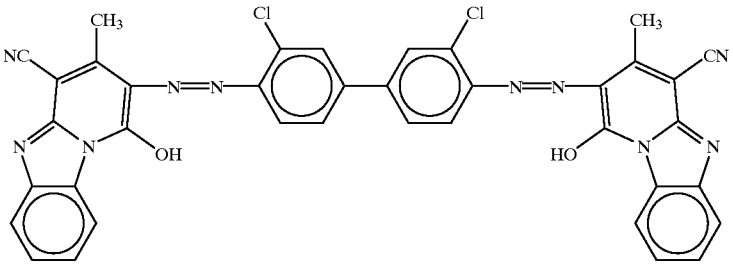

I-4

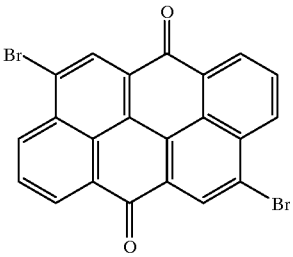

As a binder for the charge generation layer, polycarbonate, polyester, polyamide, polyurethane, epoxy, polyvinyl butyral, polyvinyl acetal, phenoxy resin, silicone resin, acrylic resin, polyvinyl chloride resin, polyvinylidenechloride resin, polyvinylacetate resin, formal resin, cellulose resin, or copolymers thereof, and halogenated or cyanoethylated compounds thereof can be used. Since the charge generation layer 3 is sufficient to have only a charge generation function, the film thickness is generally within a range to obtain a necessary photosensitivity and is designed as thin as possible, generally with a film thickness of 0.1 to 5 $\mu$m, preferably 0.1 to 1 $\mu$m.

Amount of these phthalocyanine compounds is 5 to 500 parts by weight, preferably 10 to 100 parts by weight with respect to 10 parts by weight of the resin binder.

The charge transport layer 4 is a coated film comprising a material containing an organic charge transport substance dispersed in a resin binder, which maintains the charge of the photoconductor as an insulator layer in a dark place, and when receiving light, has a function to transport the charge injected from the charge generation layer. As charge transport substances in the charge transport layer, shown as the following chemical formulas (Examples II-1 to 7), various hydrazone, styryl, diamine, butadiene, indole compounds, and mixtures thereof can be used.

II-1

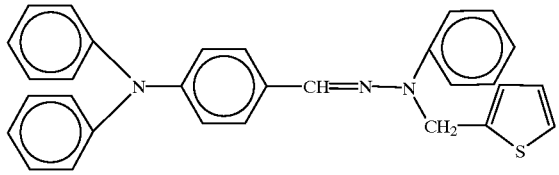

II-2

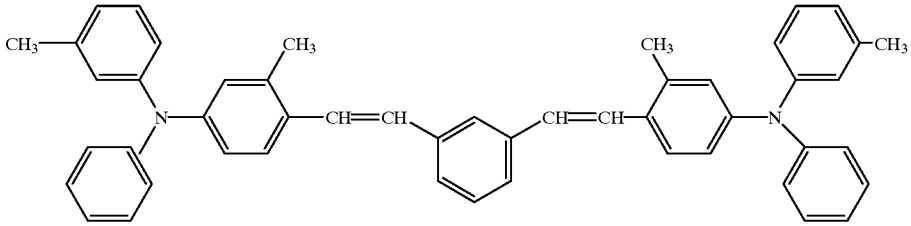

II-3

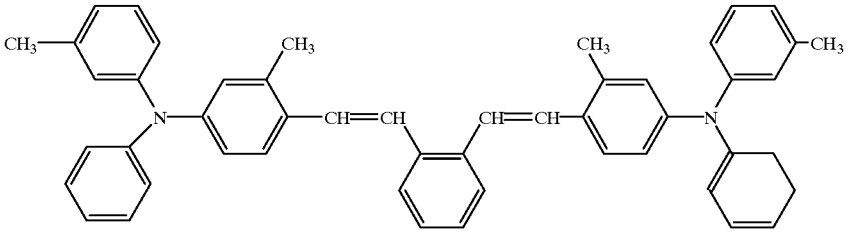

II-4

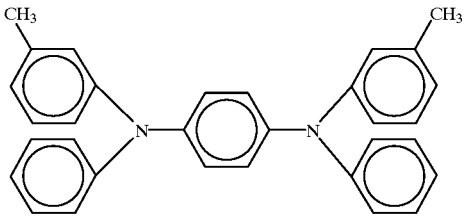

II-5

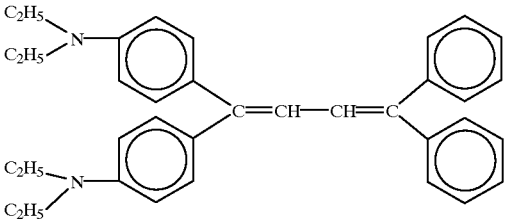

II-6

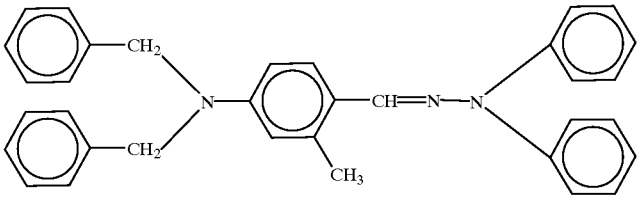

-continued

II-7

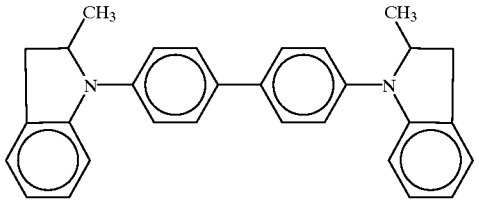

As a binder for the charge transport layer, polycarbonate, polystyrene, polyphenylene ether acrylic resins, and the like are considered as known materials, and polycarbonate is widely used in practical applications as presently the best material group in terms of film strength and resistance to repeated printing resistance. Such polycarbonates include bisphenol A type and bisphenol Z type, shown as the following chemical formulas (Examples III-1 to 2), and various copolymers.

III-1

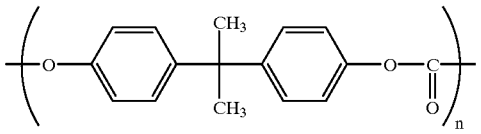

-continued

III-2

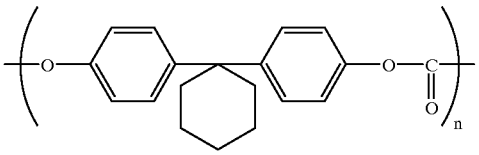

An optimum average molecular weight range of the polycarbonate resins is 10,000 to 100,000. Further, as an antioxidant added to the charge transport layer, a single system or appropriate combinations of antioxidants shown as the following chemical formulas (Examples IV-1 to 4) can be used. The charge transport layer preferably has a thickness of 10 to 50 $\mu$m.

IV-1

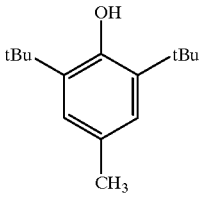

IV-2

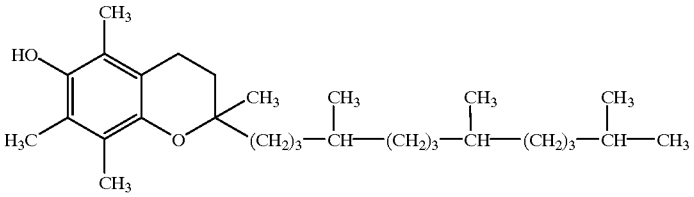

IV-3

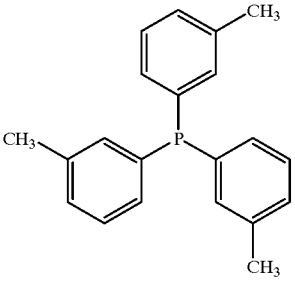

-continued

IV-4

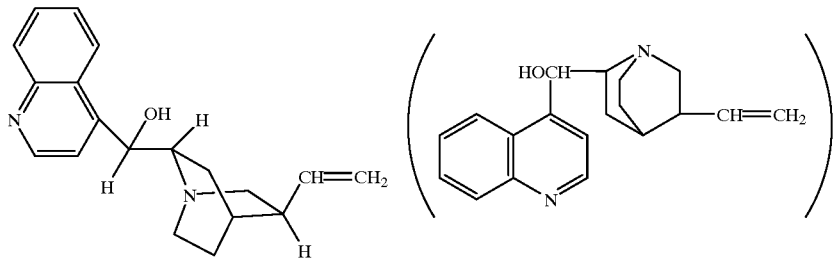

To the undercoating layer, the charge generation layer, and the charge transport layer, with the aim of improving sensitivity, reducing residual potential, improvement of environmental resistance or stability to harmful light, or the like, an electron accepting substance, an antioxidant, a light stabilizer, or the like can be added as necessary.

Further, on the above photosensitive layer, a surface protective layer may be provided for the purpose of improving the environmental resistance and mechanical strength. The surface protective layer is desirably one which does not substantially disturb transmission of light.

EMBODIMENTS

Next, the present invention will be described in detail with reference to the embodiments.

COMPARATIVE EXAMPLE 1

After a cylindrical aluminum substrate was finished by cutting into desired dimensions, degreasing was carried out with a degreasing agent (TOPALCLEAN 101: from Okuno Chemical Industries Co., Ltd./60° C./2 minutes), and thoroughly washed with water to remove the degreasing agent. After that, the aluminum substrate was subjected to electrolytic treatment (1.0 A/dm$^2$/12V/21 minutes) in sulfuric acid (180 g/l, 20° C.) to obtain an anodic oxidation film with a thickness of 7 $\mu$m, and then washed with water. Sealing treatment was carried out using nickel acetate (6 g/l) as a sealing agent at temperatures of 60, 70, 80, and 90° C., (i.e., four different temperature conditions) for 5 and 10 minutes (i.e., two different time conditions), respectively.

COMPARATIVE EXAMPLE 2

Sealing treatment was carried out using the same procedure as in Comparative Example 1 except that pure water (ion exchanged water) was used in place of nickel acetate.

Embodiment 1

(1) In the sealing treatment, the same treatment was carried out as in Comparative Example 1, except that a phosphate type surfactant (PHOSPHANOL RS-610: from Toho Chemical Industry Co., Ltd.) was added in amounts of 0.01, 0.02, 0.05, 0.1, 1.0, 2.0, and 2.2 g/l (7 conditions) to nickel acetate (6 g/l). The treatment was performed at 90° C. for 10 minutes.

(2) In the sealing treatment, the same treatment was carried out as in Comparative Example 1, except that a phosphate type surfactant (TOPSEAL E110: from Okuno Chemical Industries Co., Ltd.) was added in amounts of 0.2, 0.5, 1.0, 5.0, 10.0, 20.0, and 22.0 ml/l (i.e., seven conditions) to nickel acetate (6 g/l). Then, the treatment was performed at 90° C. for 10 minutes.

Embodiment 2

In the sealing treatment, the same treatment procedure was used as in Embodiment 1 except that pure water was used in place of nickel acetate.

Embodiment 3

In the sealing treatment, the same treatment was carried out as in Comparative Example 1, except that a naphthalene sulfonate type formaldehyde condensate (DEMOL N: from Kao Corporation) was added in amounts of 0.1, 0.2, 3.0, 8.0, 10.0 and 12.0 g/l (i.e., six conditions) to nickel acetate (6 g/l), and the treatment was performed at 90° C. for 10 minutes.

Embodiment 4

In the sealing treatment, the same treatment procedure was used as in Embodiment 3 except that pure water was used in place of nickel acetate.

Embodiment 5

In the sealing treatment, the same treatment was carried out as in Comparative Example 1, except that a bisphenol A sulfonate type formaldehyde condensate (AMN-01: from Senka Co., Ltd.) was added in amounts of 0.1, 0.2, 1.0, 5.0, 10.0, 20.0 and 22.0 g/l (i.e., seven conditions) to nickel acetate (6 g/l), and the treatment was performed at 90° C. for 10 minutes.

Embodiment 6

In the sealing treatment, the same treatment procedure was used as in Embodiment 5 except that pure water was used in place of nickel acetate.

The pit sealed cylindrical aluminum substrates produced in above Comparative Examples 1 and 2 and Embodiments 1 to 6 were washed with an alkaline washing agent (2% CASTROL 450: from Castrol Co., Ltd.) for 1 minute and dried at 60° C. The resulting substrate was coated sequentially with a charge generation layer and a charge transport layer, as a photosensitive layer. The charge generation layer comprises an X type metal-free phthalocyanine having an average particle diameter of 200 nm, dispersed in a ratio of 4:6 in a vinyl chloride—vinyl acetate copolymer. The charge transport layer was obtained by coating a mixture of a butadiene type charge transport agent and a polycarbonate type resin (molecular weight: about 30,000) followed by drying at 80° C. for 2 hours.

The above samples of Comparative Examples and Embodiments were evaluated for admittance value ($Y_{20}$) and uniformity of coated film after coating the photosensitive layer. The admittance was determined by JIS H 8683 (1994). Further, uniformity of the coated film was evaluated by visual observation. The results are shown in Tables 1 to 5. Evaluation of uniformity of the coated film is represented as "++" for good, as "+" for normal, or as "−" for poor uniformity. Normal uniformity means that an effect is noted compared to Comparative Examples, however, quality required for the product is not satisfied. When a pit sealed film has a reticulated surface state having irregularities, uniformity of the coated film after coating the photosensitive layer is evaluated as poor as "−" then the pit sealed film is not reticulated but is smooth and uniform, the coated film is evaluated as good as "++".

TABLE 1

| | Pit sealing agent | Phosphate type surfactant | Sealing condition Temp. (° C.) | Sealing condition Time (min.) | Coated film uniformity | $Y_{20}$ (μS) | Total evaluation |
|---|---|---|---|---|---|---|---|
| Comparative example 1 | Nickel acetate (6 g/l) | None | 60 | 5 | ++ | 123 | – |
| | | | 70 | | ++ | 100 | – |
| | | | 80 | | – | 65 | – |
| | | | 90 | | – | 60 | – |
| | | | 60 | 10 | ++ | 100 | – |
| | | | 70 | | ++ | 95 | – |
| | | | 80 | | – | 50 | – |
| | | | 90 | | – | 40 | – |
| Comparative example 2 | Pure water | None | 60 | 5 | ++ | 130 | – |
| | | | 70 | | ++ | 110 | – |
| | | | 80 | | – | 70 | – |
| | | | 90 | | – | 60 | – |
| | | | 60 | 10 | ++ | 120 | – |
| | | | 70 | | ++ | 95 | – |
| | | | 80 | | – | 62 | – |
| | | | 90 | | – | 45 | – |

TABLE 2

| | Pit sealing agent | Phosphate type surfactant Type | Phosphate type surfactant Conc. | Sealing condition Temp. (° C.) | Sealing condition Time (min.) | Coated film uniformity | $Y_{20}$ (μS) | Total evaluation |
|---|---|---|---|---|---|---|---|---|
| Embodiment 1 (1) | Nickel acetate (6 g/l) | PHOSPHANOL RS-610 | 0.01 g/l | 90 | 10 | + | 42 | + |
| | | | 0.02 | | | ++ | 43 | ++ |
| | | | 0.05 | | | ++ | 50 | ++ |
| | | | 0.10 | | | ++ | 55 | ++ |
| | | | 1.00 | | | ++ | 60 | ++ |
| | | | 2.00 | | | ++ | 55 | ++ |
| | | | 2.20 | | | ++ | 74 | – |
| Embodiment 1 (2) | | TOPSEAL E110 | 0.2 ml/l | 90 | 10 | + | 45 | – |
| | | | 0.50 | | | ++ | 53 | ++ |
| | | | 1.00 | | | ++ | 54 | ++ |
| | | | 5.00 | | | ++ | 62 | ++ |
| | | | 10.0 | | | ++ | 67 | ++ |
| | | | 20.0 | | | ++ | 66 | ++ |
| | | | 22.0 | | | ++ | 73 | – |

TABLE 3

| | Pit sealing agent | Phosphate type surfactant Type | Phosphate type surfactant Conc. | Sealing condition Temp. (° C.) | Sealing condition Time (min.) | Coated film uniformity | $Y_{20}$ (μS) | Total evaluation |
|---|---|---|---|---|---|---|---|---|
| Embodiment 2 (1) | Pure water | PHOSPHANOL RS-610 | 0.01 g/l | 90 | 10 | – | 50 | – |
| | | | 0.02 | | | ++ | 53 | ++ |
| | | | 0.05 | | | ++ | 58 | ++ |
| | | | 0.10 | | | ++ | 65 | ++ |
| | | | 1.00 | | | ++ | 66 | ++ |
| | | | 2.00 | | | ++ | 67 | ++ |
| | | | 2.20 | | | ++ | 75 | – |
| Embodiment 2 (2) | Pure water | TOPSEAL E110 | 0.2 ml/l | 90 | 10 | – | 55 | – |
| | | | 0.50 | | | ++ | 54 | ++ |
| | | | 1.00 | | | ++ | 54 | ++ |
| | | | 5.00 | | | ++ | 59 | ++ |
| | | | 10.0 | | | ++ | 60 | ++ |
| | | | 20.0 | | | ++ | 66 | ++ |
| | | | 22.0 | | | ++ | 75 | – |

TABLE 4

| | Pit sealing agent | Naphthalene sulfonate formaldehyde condensate Type | Conc. (g/l) | Sealing condition Temp. (° C.) | Time (min.) | Coated film uniformity | $Y_{20}$ (μS) | Total evaluation |
|---|---|---|---|---|---|---|---|---|
| Embodiment 3 | Nickel acetate (6 g/l) | DEMOL N | 0.1 | 90 | 10 | + | 45 | + |
| | | | 0.2 | | | ++ | 44 | ++ |
| | | | 3.0 | | | ++ | 46 | ++ |
| | | | 8.0 | | | ++ | 46 | ++ |
| | | | 10.0 | | | ++ | 48 | ++ |
| | | | 12.0 | | | ++ (colored) | 43 | + |
| Embodiment 4 | Pure water | DEMOL N | 0.1 | 90 | 10 | – | 47 | – |
| | | | 0.2 | | | ++ | 50 | ++ |
| | | | 3.0 | | | ++ | 51 | ++ |
| | | | 8.0 | | | ++ | 48 | ++ |
| | | | 10.0 | | | ++ | 48 | ++ |
| | | | 12.0 | | | ++ (colored) | 49 | + |

TABLE 5

| | Pit sealing agent | Bisphenol A sulfonate formaldehyde condensate Type | Conc. (g/l) | Sealing condition Temp. (° C.) | Time (min.) | Coated film uniformity | $Y_{20}$ (μS) | Total evaluation |
|---|---|---|---|---|---|---|---|---|
| Embodiment 5 | Nickel acetate (6 g/l) | AMN-01 | 0.1 | 90 | 10 | + | 45 | + |
| | | | 0.2 | | | ++ | 46 | ++ |
| | | | 1.0 | | | ++ | 46 | ++ |
| | | | 5.0 | | | ++ | 45 | ++ |
| | | | 10.0 | | | ++ | 43 | ++ |
| | | | 20.0 | | | ++ | 43 | ++ |
| | | | 22.0 | | | ++ (Colored) | 47 | + |
| Embodiment 6 | Pure water | AMN-01 | 0.1 | 90 | 10 | + | 50 | + |
| | | | 0.2 | | | ++ | 51 | ++ |
| | | | 1.0 | | | ++ | 48 | ++ |
| | | | 5.0 | | | ++ | 48 | ++ |
| | | | 10.0 | | | ++ | 50 | ++ |
| | | | 20.0 | | | ++ | 47 | ++ |
| | | | 22.0 | | | ++ (Colored) | 48 | + |

As can be seen from the above evaluation results, by adding a specific surfactant and the like in the sealing treatment, a uniform surface is obtained with an admittance value ($Y_{20}$) of 70 μS or less. Such results have also been noted when the photoconductor is constructed with materials other than those for the charge generation layer and the charge transport layer used in the present invention.

In Comparative Examples 1 and 2, uniformity of the coated film is deteriorated under a condition where $Y_{20}$ is 70 μS or less. This tendency is quite the same even when nickel acetate or pure water is used. In Embodiments 1 and 2, when the surfactant concentration is increased, sealing disturbance occurs where $Y_{20}$ becomes greater than 70 μS. In Embodiments 3 to 6, coloring occurs when an excess amount of the condensate is added.

As described above, with the present invention, the admittance value ($Y_{20}$) is reduced to 70 μS or less, and growth of the film in the vertical direction is suppressed, thereby obtaining a substrate for an electrophotographic photoconductor having a surface of uniform wettability with high sealing degree. Therefore, an electrophotographic photoconductor using the present substrate can provide superior image characteristics.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. A method for producing an electrophotographic photoconductor having an electroconductive substrate, comprising the steps of:

providing an aluminum substrate;

forming an anodic oxidation film on at least one surface of the aluminum substrate;

adding an additive selected from the group consisting of a phosphate surfactant, a naphthalene sulfonate formaldehyde condensate, and a bisphenol A sulfonate formaldehyde condensate to a sealing agent to prepare a sealing agent mixture; and treating the substrate with the sealing agent mixture to provide the electroconductive substrate; and laminating a photosensitive film on the electroconductive substrate.

2. The method as claimed in claim 1, wherein said sealing agent is nickel acetate.

3. The method as claimed in claim 1, wherein said sealing agent is pure water.

4. An electrophotographic photoconductor, comprising:

an electroconductive substrate; and a photosensitive film laminated on said electroconductive substrate, wherein said electroconductive substrate comprises an aluminum substrate which has an anodic oxidation film on at least one surface thereof and which has been treated with a sealing agent mixture comprising an additive selected from the group consisting of a phosphate ester surfactant, a naphthalene sulfonate formaldehyde condensate, and a bisphenol A sulfonate formaldehyde condensate and a sealing agent.

5. The electrophotographic photoconductor as claimed in claim 4, wherein said sealing agent is nickel acetate.

6. The electrophotographic photoconductor as claimed in claim 4, wherein said sealing agent is pure water.

7. The electrophotographic photoconductor as claimed in claim 4, wherein said electroconductive substrate has an admittance value of 70 $\mu$S or less.

* * * * *